US009435312B2

(12) United States Patent
Neet

(10) Patent No.: US 9,435,312 B2
(45) Date of Patent: Sep. 6, 2016

(54) DIAGNOSTIC SYSTEM AND METHOD FOR VEHICLE STARTER

(71) Applicant: Remy Technologies, LLC, Pendleton, IN (US)

(72) Inventor: Kirk Neet, Pendleton, IN (US)

(73) Assignee: Remy Technologies, LLC, Pendleton, IN (US)

( * ) Notice: Subject to any disclaimer, the term of this patent is extended or adjusted under 35 U.S.C. 154(b) by 359 days.

(21) Appl. No.: 14/208,841

(22) Filed: Mar. 13, 2014

(65) Prior Publication Data

US 2014/0278020 A1 Sep. 18, 2014

Related U.S. Application Data

(60) Provisional application No. 61/789,483, filed on Mar. 15, 2013.

(51) Int. Cl.

| | |
|---|---|
| ***F02N 15/00*** | (2006.01) |
| ***F02N 11/10*** | (2006.01) |
| ***F02N 11/08*** | (2006.01) |
| *F02N 15/02* | (2006.01) |
| *F02N 15/06* | (2006.01) |

(52) U.S. Cl.

CPC ..... *F02N 11/108* (2013.01); *F02N 11/087* (2013.01); *F02N 15/022* (2013.01); *F02N 15/062* (2013.01); *F02N 15/067* (2013.01); *F02N 2200/047* (2013.01); *F02N 2200/048* (2013.01)

(58) Field of Classification Search

CPC ..... F02N 11/108; F02N 11/087; F02N 2200/047; F02N 2200/048; F02N 15/167; F02N 15/062; F02N 15/022

See application file for complete search history.

(56) References Cited

U.S. PATENT DOCUMENTS

| | | | | |
|---|---|---|---|---|
| 6,553,816 | B1 | 4/2003 | Palanisamy et al. | |
| 7,275,509 | B2 | 10/2007 | Kassner | |
| 8,251,034 | B2 * | 8/2012 | Hashim | F02D 29/02 123/179.25 |
| 8,290,692 | B2 | 10/2012 | Kitano et al. | |
| 8,482,140 | B2 | 7/2013 | Yu et al. | |
| 8,789,507 | B2 * | 7/2014 | Doub | F02N 11/10 123/179.3 |
| 9,203,287 | B2 * | 12/2015 | Omata | F02N 15/023 |
| 2011/0174255 | A1 | 7/2011 | Neuburger et al. | |
| 2011/0202254 | A1 | 8/2011 | Ishikawa et al. | |
| 2012/0109430 | A1 | 5/2012 | Rollmann et al. | |

(Continued)

FOREIGN PATENT DOCUMENTS

JP 2002-070699 3/2002

*Primary Examiner* — Hieu T Vo
*Assistant Examiner* — Sherman Manley
(74) *Attorney, Agent, or Firm* — Bose McKinney & Evans LLP

(57) ABSTRACT

A diagnostic system and method for a vehicle with a starter-based stop-start system. At least one diagnostic check is performed before stopping the engine as a function of the stop-start system. Both diagnostic checks may be performed. If a diagnostic check indicates a failure of the starter motor or solenoid, operation of the stop-start system is suspended. The system utilizes a sensor to determine if the starter shaft is rotating when the shaft is in a position wherein a gear on the shaft is disengaged. Operability of the starter motor is checked by energizing and then de-energizing the motor without engaging the gear and determining if the shaft rotates. Operability of the solenoid is checked by sensing the rotation of the starter shaft and then energizing the solenoid to move the shaft into a position where the sensor cannot detect rotation of the shaft.

20 Claims, 5 Drawing Sheets

(56) References Cited

U.S. PATENT DOCUMENTS

2012/0304818 A1 12/2012 Moriya et al.
2013/0035815 A1 2/2013 Ando et al.
2013/0035839 A1 2/2013 Otanez et al.
2013/0231848 A1 9/2013 Roberts et al.
2014/0260795 A1* 9/2014 Gray ..... F02N 11/00 74/7 E

* cited by examiner

DIAGNOSTIC SYSTEM AND METHOD FOR VEHICLE STARTER

CROSS REFERENCE TO RELATED APPLICATIONS

This application claims priority under 35 U.S.C. 119(e) of U.S. provisional patent application Ser. No. 61/789,483 filed on Mar. 15, 2013 entitled DIAGNOSTIC SYSTEM AND METHOD FOR VEHICLE STARTER the disclosure of which is hereby incorporated herein by reference.

BACKGROUND

The present invention relates to vehicles which include an internal combustion engine and, more specifically, to starters used with such vehicles.

Conventional internal combustion engine vehicles utilize a starter when initially starting the internal combustion engine. Typically, a battery powers an electrical starter motor which turns a flywheel and thereby turns the engine over. The starter provides torque to the engine for a brief period of time until the engine starts to operate normally and no longer needs assistance.

In a conventional vehicle, the starter will be used when initially starting the engine and the engine will continue to run until the operator intentionally stops the engine. Recently, however, many vehicles have begun employing a stop-start system where the electronic control unit ("ECU") of the vehicle intentionally stops the engine based upon the operating conditions of the vehicle and subsequently restarts the engine based upon operating conditions of the vehicle. This stopping and starting of the engine occurs without the operator of the vehicle actively stopping or starting the engine.

Hybrid vehicles often employ a stop-start system to temporarily stop the operation of the internal combustion engine when the vehicle is brought to a stop or when the forward propulsion of the vehicle can be entirely provided by an electric traction motor. It is also becoming increasingly desirable to provide a stop-start system in non-hybrid vehicles which are entirely reliant upon an internal combustion engine for propulsion. In such non-hybrid vehicles, the stop-start system will typically only stop the engine when the brake is being applied and the vehicle is being brought to a stop or when the vehicle is stopped. The use of a stop-start system in such vehicles will, thereby, typically turn off the engine when the vehicle is stopped and in an idling situation. By automatically turning off the engine in such idling situations, the stop-start system not only enhances fuel-economy but also reduces emissions.

In many vehicles, the starter used to initially start the engine is also used when the ECU automatically restarts the engine after stopping the engine as a part of a stop-start system. The start-stop system may have "change-of-mind" capabilities wherein it is able to restart the engine very shortly after the engine was stopped and the fly-wheel is still inertially rotating. In such starter-based stop-start systems, the starter will typically have a pinion gear that is capable of engaging a rotating ring gear that is coupled with a flywheel to thereby restart the engine. Such starters may have what is referred to as a synchronized design wherein the rotational speeds of both the pinion gear and the ring gear are sensed and the pinion gear is engaged only when the speeds of the two gears are synchronized. A solenoid is typically used to move the pinion gear into and out of engagement with the ring gear.

In such starter-based stop-start systems, the starter is subjected to greater demands than a conventional starter in a vehicle without a stop-start system. While it is always undesirable to have a vehicle starter fail, in a conventional vehicle without a stop-start system, if the starter fails, the vehicle will generally be stranded at a location where the operator had intentionally parked the vehicle and stopped the engine. In a vehicle having a stop-start system, if the starter fails after the ECU had automatically stopped the engine as a function of the stop-start system, the vehicle has a greater possibility of being stranded in a highly inconvenient location such as a left turn lane at a busy intersection.

SUMMARY

The present invention provides a diagnostic system that can be used in a starter based stop-start system to check the operability of the starter motor and/or the starter solenoid before the ECU stops the engine. If either the starter motor or the solenoid fails the diagnostic test, the ECU will not stop the engine as a function of the stop-start system and the engine will be allowed to run continuously until the operator of the vehicle intentionally stops the engine.

The invention comprises, in one embodiment thereof, a diagnostic system for a vehicle with an internal combustion engine and a starter-based stop-start system that includes an electronic control unit configured to control the operation of the stop-start system, a starter having an electric motor drivingly coupled with a shaft assembly and a first gear mounted on the shaft assembly. A solenoid is operably coupled with the shaft assembly wherein operation of the solenoid shifts the first gear into and out of engagement with a second gear. The second gear is coupled with the engine and the engine can be started by rotating the second gear with the first gear. A sensor is operably coupled with the shaft assembly for detecting rotational movement of the shaft assembly in a first position wherein the first gear is disengaged from the second gear. The electronic control unit is operably coupled with the starter motor, the solenoid and the sensor and the electronic control unit performs at least one of a first diagnostic check and a second diagnostic check before stopping the engine as a function of the stop-start system. In the first diagnostic check, the electronic control unit energizes and then de-energizes the starter motor with the pinion gear disengaged from the ring gear and then, with the shaft assembly in the first position, uses the sensor to determine if the shaft assembly is rotating. A rotating shaft assembly indicates that the starter motor is operable and a non-rotating shaft assembly indicates a starter motor failure. In the second diagnostic check, the electronic control unit detects the rotational speed of the shaft assembly with the sensor while the shaft assembly is in the first position and the shaft assembly is rotating, the electronic control unit then energizes the solenoid to move the shaft assembly out of the first position to a second position where the sensor cannot detect rotation of the shaft assembly. The electronic control unit then analyzes the signals provided by the sensor after energizing the solenoid. Sensor signals representing no detected rotation of the shaft assembly after energizing the solenoid to move the shaft assembly to the second position indicates that the solenoid is operable and sensor signals representing a non-zero rotational speed of the shaft assembly after energizing the solenoid to move the shaft assembly to the second position indicates a solenoid failure due to the solenoid failing to move the shaft assembly out of the first position. If a starter motor failure or a solenoid failure is detected when conducting the at least one of the first and second diagnostic checks, the electronic control unit suspends operation of the stop-start system.

The invention comprises, in another embodiment thereof, a method of performing a diagnostic check for a vehicle with an internal combustion engine and a starter-based stop-start system. The method includes providing a starter having an electric motor drivingly coupled with a shaft assembly; providing a first gear on the shaft assembly; operably coupling a solenoid with the shaft assembly wherein the solenoid selectively shifts the pinion gear into and out of engagement with a second gear coupled with the engine and wherein the engine can be started by rotating the second gear with the first gear. A sensor is operably coupled with the shaft assembly wherein the sensor detects rotational movement of the shaft assembly when the shaft assembly is in a first position with the first gear disengaged from the second gear. The method also includes performing at least one of a first diagnostic check and a second diagnostic check before stopping the engine as a function of the stop-start system. The first diagnostic check includes energizing and then de-energizing the starter motor with the first gear disengaged from the second gear and then, with the shaft assembly in the first position, using the sensor to determine if the shaft assembly is rotating. A rotating shaft assembly indicates that the starter motor is operable and a non-rotating shaft assembly indicates a starter motor failure. The second diagnostic check includes detecting the rotational movement of the shaft assembly with the sensor while the shaft assembly is in the first position and the shaft assembly is rotating and then energizing the solenoid to move the shaft assembly out of the first position to a second position where the sensor cannot detect rotation of the shaft assembly. The signals provided by the sensor after energizing the solenoid are then analyzed wherein sensor signals representing no detected rotation of the shaft assembly after energizing the solenoid to move the shaft assembly to the second position indicates that the solenoid is operable and sensor signals representing a non-zero rotational speed of the shaft assembly after energizing the solenoid to move the shaft assembly to the second position indicates a solenoid failure due to the solenoid failing to move the shaft assembly out of the first position. Operation of the stop-start system is suspended if a starter motor failure or a solenoid failure is detected by the at least one of the first and second diagnostic checks.

Different embodiments of the system and method include the performance of only the first diagnostic check, only the second diagnostic check or performance of both diagnostic checks.

In some embodiments the motor is energized and then de-energized to rotate the shaft assembly and, when performing the second diagnostic check, the solenoid is energized after de-energizing the motor. In such embodiments, the second diagnostic check is advantageously performed immediately after completing the first diagnostic check whereby a single energizing and de-energizing of the starter motor can be used to accomplish both the first and second diagnostic checks.

In still other embodiments wherein the second diagnostic check is performed immediately after completing the first diagnostic check and wherein a single energizing and de-energizing of the starter motor is used to accomplish both the first and second diagnostic checks, the second diagnostic check may further include monitoring the sensor for a non-zero rotational speed during a predetermined time period following the detection of a zero rotational speed and de-energizing of the solenoid and wherein the second diagnostic check indicates the solenoid is operable only if a non-zero rotational speed is detected during the predetermined time period.

Some embodiments advantageously perform the first and second diagnostic checks after the electronic control unit determines that operating conditions necessary to temporarily stop the engine as a function of the stop-start system are satisfied and before stopping the engine as a function of the stop-start system.

In yet other embodiments, the first gear is a pinion gear, the second gear is a ring gear, and the sensor is a Hall effect sensor. In such embodiments, the shaft assembly may include an overriding clutch assembly and a plurality of circumferentially spaced ferrous targets mounted on the clutch assembly wherein the targets are detectable by the Hall effect sensor.

In still other embodiments, the electronic control unit communicates a warning signal to the operator of the vehicle if a diagnostic check failure occurs. Such a warning may be a generic warning, e.g., a check engine warning, which does not specifically identify the problem as impacting the stop-stop system. Alternatively, the warning signal may be more specific and communicate that a failure has occurred in the stop-start system.

BRIEF DESCRIPTION OF THE DRAWINGS

The above mentioned and other features of this invention, and the manner of attaining them, will become more apparent and the invention itself will be better understood by reference to the following description of an embodiment of the invention taken in conjunction with the accompanying drawings, wherein.

Figure 1:
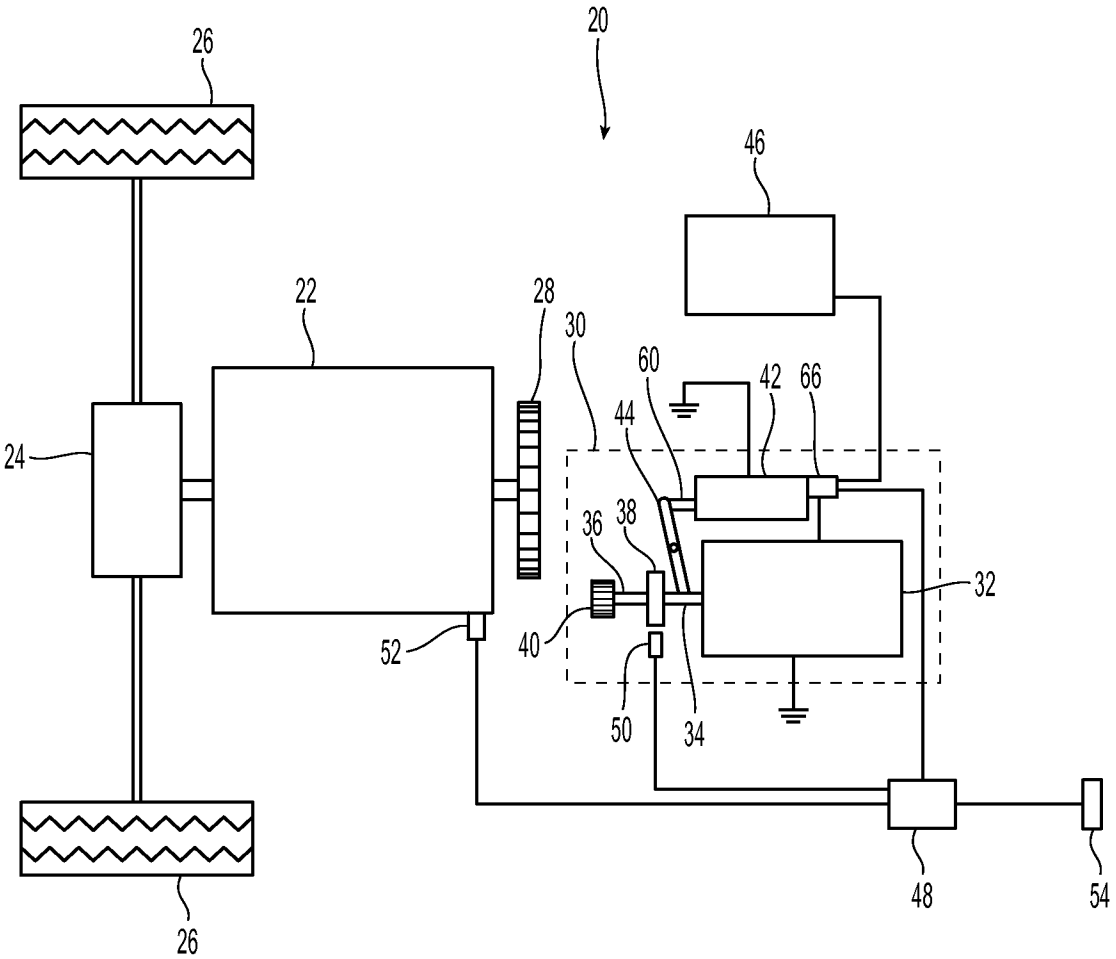
FIG. 1 is schematic view of a vehicle with a starter-based stop-start system.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DETAILED DESCRIPTION

FIG. 1 schematically depicts a vehicle 20 with a starter-based stop-start system. Vehicle 20 includes an internal combustion engine 22 and a drivetrain 24 that transmits torque from engine 22 to driven wheels 26. Although the depicted vehicle 20 is a front-wheel drive passenger car, the diagnostic system and method disclosed herein can be used with any vehicle employing a starter-based stop-start system. In the illustrated embodiment, a ring gear 28 is mounted on the outer circumference of a flywheel coupled to the drive shaft of engine 22.

Starter assembly 30 is used to rotate the flywheel when starting engine 22. Starter assembly 30 includes an electric motor 32 having field coils, armature, commutator, carbon brushes, and supporting frame and housing. The armature windings and commutator are mounted on a shaft 34 which is coupled to a pinion shaft 36 by an overrunning clutch 38.

The illustrated starter motor operates in a conventional manner with the field coils forming a stationary electromagnetic field. As the armature rotates, the commutator segments contact different brushes and reverse polarity to thereby cause the continued rotation of the armature. The field coils and armature windings may form a series motor, a shunt motor or a compound motor as is well understood by those having ordinary skill in the art. Still other alternative motors may also be employed. For example, permanent magnets could be used instead of field coils.

A pinion gear 40 is mounted on pinion shaft 36 and is selectively engageable with ring gear 28. Pinion gear 40 is shifted into and out of engagement with ring gear 28 by solenoid 42 which acts on shaft 34 through a linkage assembly that includes shift lever 44. Although not used with the illustrated example, a gear reduction drive could also be employed. For example, it is known to use a gear set between the armature and pinion to reduce the rotational speed and increase the torque output by the motor to thereby allow for the use of smaller, higher speed motors. Shaft 34, pinion shaft 36, overrunning clutch 38 and other components of the drive train between motor 32 and pinion gear 40, e.g., a gear reduction drive, together form shaft assembly 35. A conventional car battery 46, or other suitable source of electrical current, is used to provide electrical current to starter motor 32 and solenoid 42.

It is noted that FIG. 1 is a schematic drawing and has been simplified to provide greater clarity in understanding the present invention. For example, a control circuit that includes the ignition switch of the vehicle and a neutral safety switch which prevents the ignition switch from activating the starter motor while the vehicle is in gear is not shown. Vehicle 20 also includes an electronic control unit ("ECU") 48 that controls the operation of starter motor 32 and solenoid 42 by means of relays or other suitable switching mechanisms. In the illustrated embodiment, a motor relay 66 is positioned adjacent solenoid 42. ECU 48 controls the operation of relay 66 to selectively energize and de-energize motor 32 independently of the status of solenoid 42.

Figure 2:
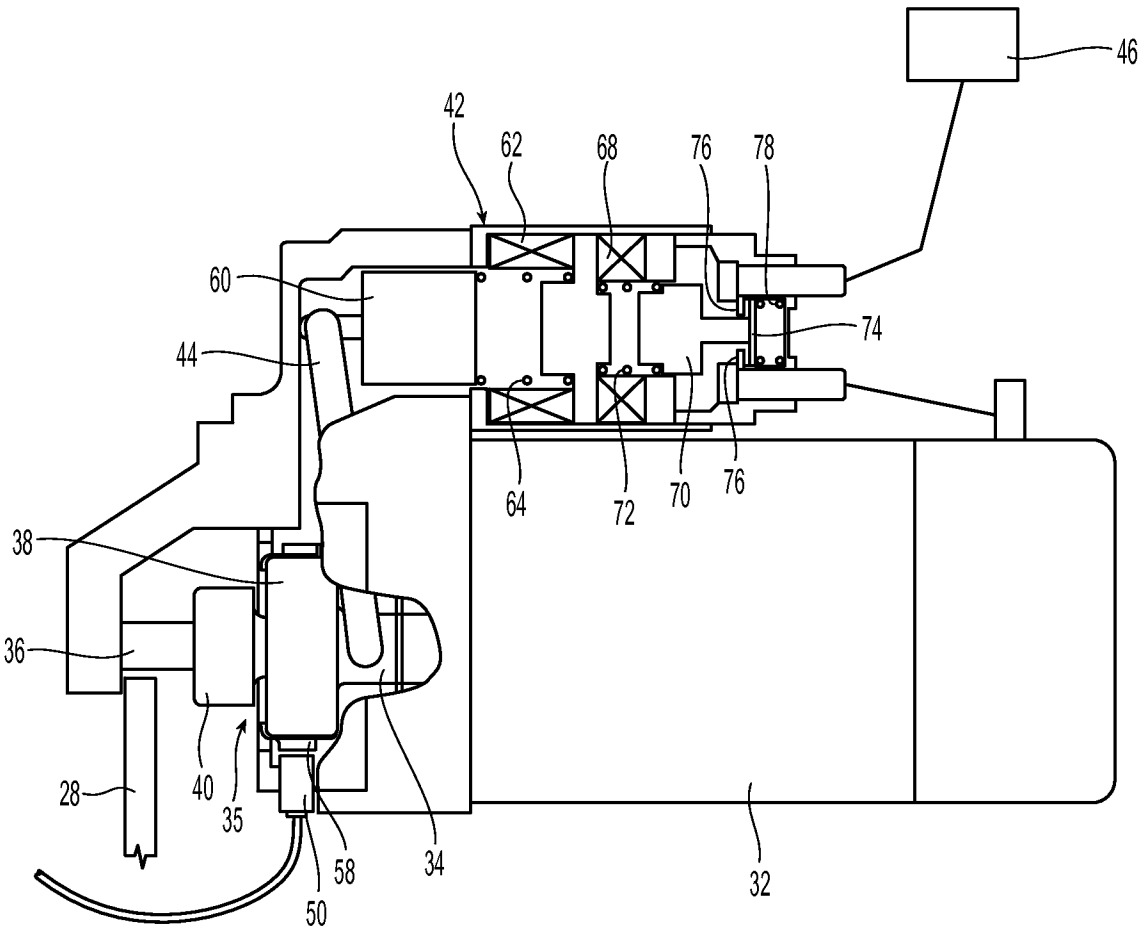
FIG. 2 is a schematic view of a starter with a de-energized motor and a pinion gear located in its disengaged home position.
Figure 3:
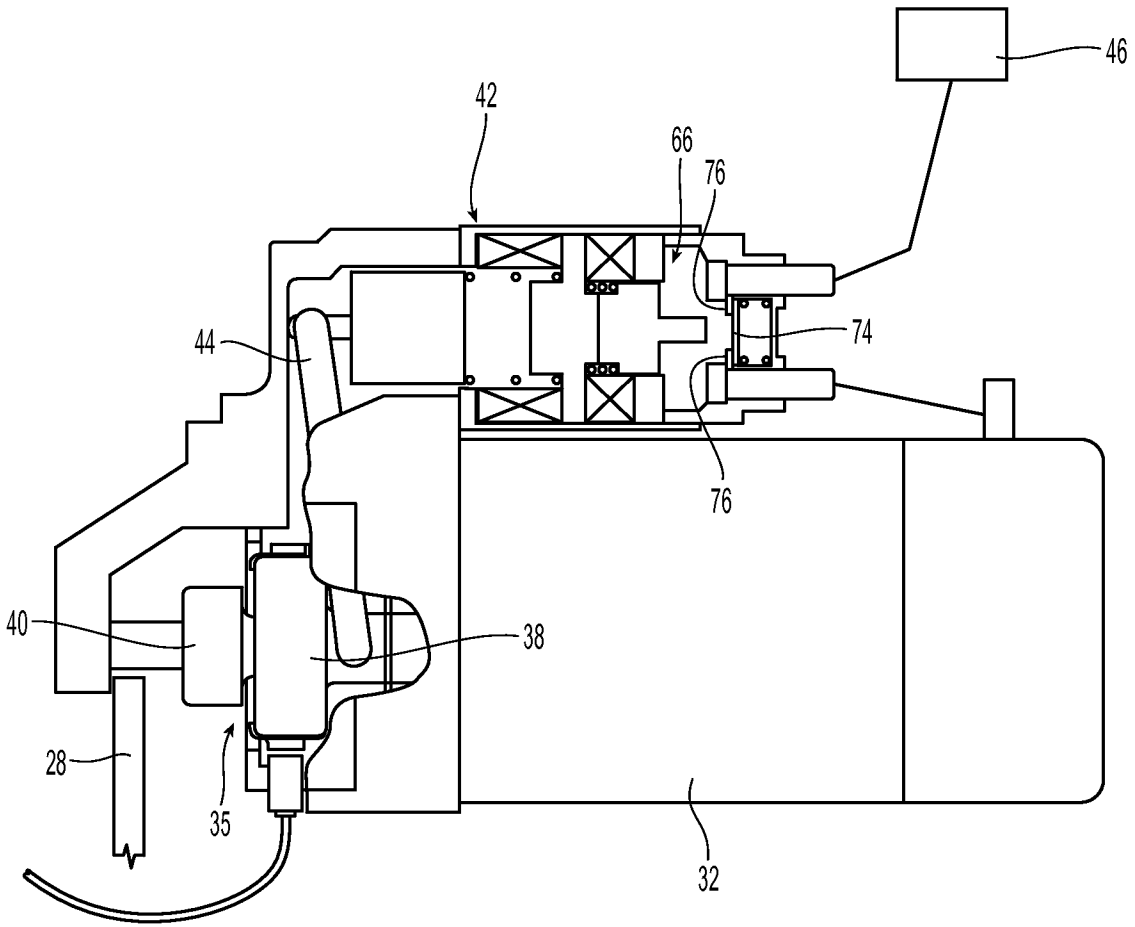
FIG. 3 is a view of the starter with an energized motor and a pinion gear in its home position.
Figure 4:
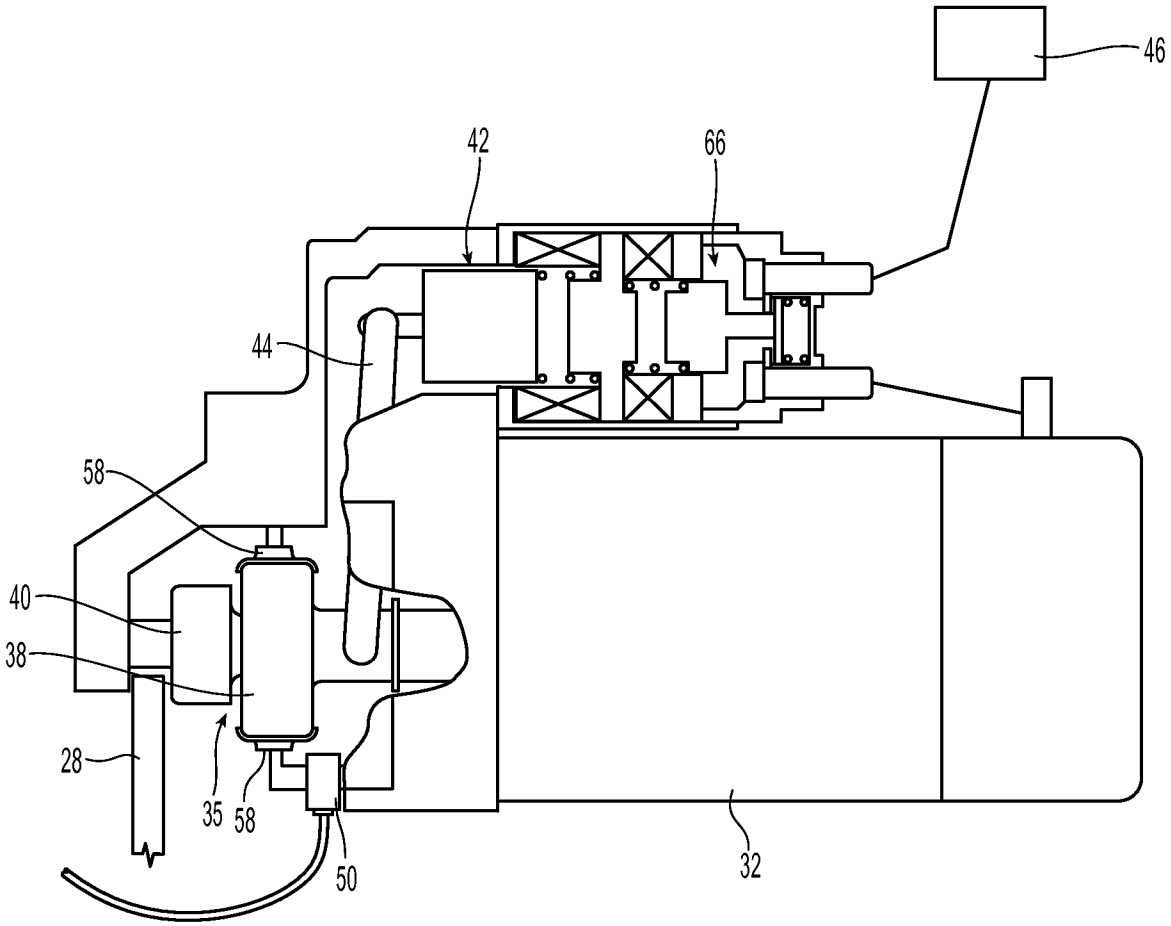
FIG. 4 is a view of the starter with an energized solenoid and a pinion gear positioned between a fully engaged position and its home position.
Figure 5:
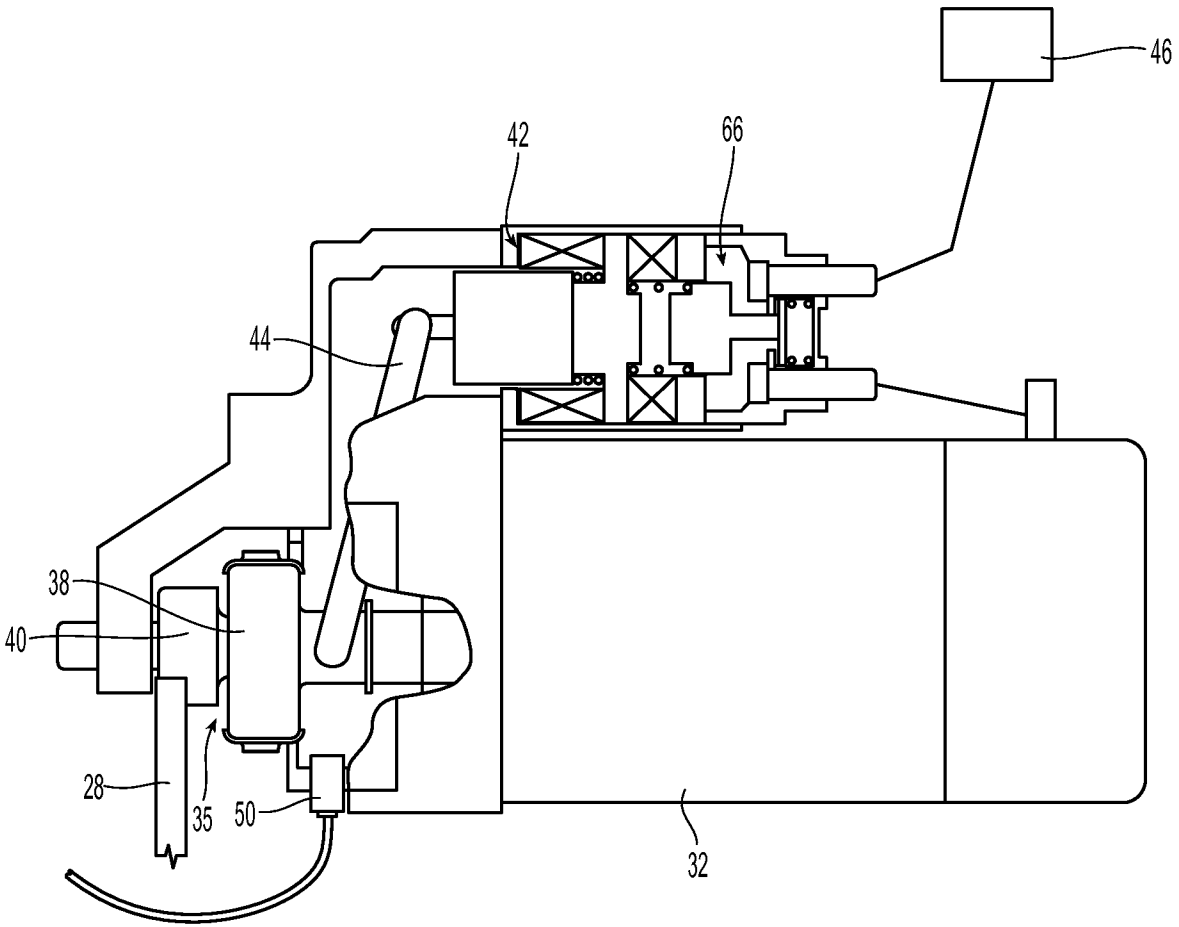
FIG. 5 is a view of the starter with the motor energized and the pinion gear in its fully engaged position.

Relay 66 includes a coil or winding 68 and a plunger 70. A spring 72 biases plunger 70 outward (toward the right in FIGS. 2-5). The distal end of plunger 70 biases a contact plate or disc 74 away from contact pads 76. When winding 68 is energized, winding 68 draws plunger 70 inward (toward the left in FIGS. 2-5). When disc 74 engages contact pads 76, it completes a circuit connecting battery 46 with motor 32 and thereby energizes motor 32. Spring 78 biases contact plate 74 toward contact pads 76 but is weaker than spring 72 whereby when relay 66 is de-energized spring 72 biases contact plate 74 away from contact pads 76 to open the circuit and de-energize motor 32. Relay 66 is closed in FIG. 3 whereby motor 32 is energized. In FIGS. 2, 4 and 5, relay 66 is open whereby motor 32 is de-energized. Although the illustrated embodiment utilizes relay 66 to selectively energize motor 32 alternative switching mechanisms may also be employed to selectively energize motor 32 independently of solenoid 42.

It is also noted that in solenoid actuated starters, the solenoid can also be used as a relay for the starter motor. In such a system, actuating the solenoid both moves the shift lever and simultaneously closes the motor circuit to energize the motor. While diagnostic checks in accordance with the invention described herein can be employed with such starter designs, it is advantageous if separate relays or other switching mechanisms are employed whereby the ECU can selectively and independently actuate the solenoid and motor. The exemplary embodiment described herein employs a starter system wherein both motor 32 and solenoid 42 can be selectively energized independently of the other.

As can be seen in FIG. 1, ECU 48 is also in communication with sensor 50 which measures the rotational speed of pinion shaft 36 and pinion 40. ECU 48 is also in communication with engine sensors 52 which may include a sensor for measuring engine speed and, thus, the rotational speed of ring gear 28. A communication device 54 is also in communication with ECU 48. Communication device 54 is used to provide information to the operator of vehicle 20 as will be further discussed below. ECU 48 also receives signals indicative of the status of the accelerator and brake (not shown) as well as other vehicle systems as will be readily appreciated by a person having ordinary skill in the art.

The operation of starter 30 is best understood with reference to FIGS. 2-5. When starting engine 22, starter motor 32 is activated and pinion gear 40 is engaged with ring gear 28 to thereby rotate the flywheel of engine 22 and provide the initial torque necessary to start engine 22. If ring gear 28 is still inertially rotating when it is desired to start engine 22, sensors 50, 52 are used to measure the rotational speed of ring gear 28 and pinion 40. ECU 48 actuates motor 32 without actuating solenoid 42 and when the rotational speeds of pinion gear 40 and ring gear 28 are sufficiently similar, ECU 48 actuates 42 to extend pinion 40 into engagement with ring gear 28.

For example, in a stop-start system, a vehicle operator may be coming to a stop at a traffic light and the light may change just as the vehicle is being stopped and the stop-start system has stopped engine 22. In such a case, where the operator releases the brake and depresses the accelerator almost immediately after engine 22 has stopped running, the flywheel will still be rotating due to inertia and pinion gear 40 will need to mesh with a rotating ring gear 28. Other "change-of-mind" situations will also be encountered by stop-start systems where engine 22 will need to be restarted before ring gear 28 has stopped rotating. In such a system employing a "synchronized" starter, once the rotational speeds of ring gear 28 and pinion 40 are sufficiently synchronized, solenoid 42 is actuated to bias pinion gear 40 into engagement with ring gear 28.

Once the engine begins running, pinion gear 40 is disengaged from ring gear 28. Before disengagement of pinion gear 40, however, it is possible for the engine speed to exceed that of the starter motor 32. Overrunning clutch 38 prevents damage to starter motor 32 in such a situation. Overrunning clutch 38 transmits torque from starter motor 32 to pinion gear 40 but freewheels in the opposite direction preventing the ring gear 28 from transmitting torque to the starter motor 32. Consequently, if engine 22 is running at a higher rotational speed than starter motor 32 while pinion gear 40 is engaged with ring gear 28, overriding clutch 38 will allow pinion shaft 36 and pinion gear 40 to rotate at a faster speed than shaft 34 which is coupled to the rotor of the starter motor 32. The use of an overrunning clutch between a starter motor and a ring gear is known to those having ordinary skill in the art and the illustrated overrunning clutch 38 operates in a conventional manner to prevent the transmission of torque from ring gear 28 to starter motor 32.

Starter 30 includes a sensor 50 for detecting the rotational speed of pinion shaft 36 and pinion gear 40. In the illustrated embodiment, sensor 50 is a Hall effect sensor and a ring 56 having radially outwardly projecting ferrous metal teeth 58 is disposed about the outer surface of the overrunning clutch on a portion of the clutch that rotates together with pinion shaft 36. The use of a Hall effect sensor with circumferentially spaced ferrous metal targets, e.g., teeth 58, to detect the rotational speed of a rotating part is well known to those having ordinary skill in the art.

As mentioned above, solenoid 42 is used to shift the position of pinion 40 into and out of engagement with ring gear 28 using shift lever 44. At one end, shift lever 44 is pinned to plunger 60 of solenoid 42 or to a projection extending from plunger 60. Shift lever 44 is pivotally mounted near its midpoint to the starter frame and has its second end coupled with armature shaft 34 by means of a collar disposed on shaft 34. When plunger 60 is pulled into solenoid 42, shift lever 44 is pivoted about its midpoint and biases pinion gear 40 into engagement with ring gear 28. FIGS. 2 and 3 illustrate plunger 60 in an extended position whereby shift lever 44 has pulled pinion gear 40 out of engagement with ring gear 28 into a home position. FIG. 4 illustrates plunger 60 in a partially retracted position with shift lever 44 having moved pinion gear 40 out of the home position but not in engagement with ring gear 28. FIG. 5 illustrates plunger 60 in a fully retracted position wherein lever arm 44 has shifted pinion gear 40 into full engagement with ring gear 28.

The collar (not shown) disposed on shaft 34 is advantageously slidable on shaft 34 with a jump spring (not shown) disposed between the collar and overrunning clutch 38. When the collar is shifted toward ring gear 28, overrunning clutch 38 and pinion 40 will also be shifted toward ring gear 28. If the teeth of pinion 40 do not initially mesh with the teeth of ring gear 28, the jump spring will become depressed and exert a biasing force on pinion 40 toward ring gear 28. Once the teeth of the two gears are aligned to allow for the engagement of pinion 40 with ring gear 28, the jump spring will bias pinion 40 into engagement with ring gear 28. A stop on shaft 34 limits the travel of and positively engages the sliding collar in the opposite direction when solenoid 42 is de-energized and lever 44 biases the collar away from ring gear 28 and disengages pinion gear 40. The use of such a collar and jump spring is well-known to those having ordinary skill in the art. The jump spring may also be placed in plunger 60 or in lever 44 as is also well known to those having ordinary skill in the art.

In FIG. 2, solenoid 42 is de-energized and plunger 60 is in an extended position. Solenoid 42 includes windings or coil 62 which attract plunger 60 when coil 62 is energized. Once coil 62 has been de-energized, a return spring 64 biases plunger 60 outwardly. In addition to the use of a single coil to form the solenoid windings, alternative embodiments may employ two separate coils in the form of a pull-in winding and a hold-in winding. In a solenoid having two separate windings, the pull-in and hold-in windings may have approximately the same number of turns with the pull-in winding formed out of a heavier wire whereby it draws more current and creates a stronger electromagnetic field. When it is desired to retract or pull-in plunger 60, both windings would be energized. Once plunger 60 has been fully retracted, a disc on plunger 60 will contact a terminal and the pull-in winding would be de-energized. The electromagnetic field of the hold-in winding is not sufficiently strong to draw plunger 60 in, but it is sufficient to hold plunger 60 in its retracted position once it has been drawn in by the combined action of the pull-in and hold-in windings. Once the hold-in winding has been de-energized, return spring 64 would bias plunger 60 outwardly.

As mentioned above, vehicle 20 has a stop-start system. As a part of the stop-start system, ECU 48 is programmed to stop the operation of engine 22 when certain operating parameters are met and subsequently restart engine 22 based upon operating parameters of the vehicle. For example, if the operator of the vehicle is applying the brake and the speed of the vehicle is at or approaching zero and certain other vehicle parameters are satisfied, e.g., the temperature of the engine is within a predetermined range, ECU 48 will stop the operation of engine 22. ECU 48 will subsequently restart engine 22 as a function of the vehicle operating parameters. For example, if the operator removes their foot from the brake pedal or upon another change in vehicle operating conditions, e.g., the battery voltage falls below a predefined limit, ECU 48 will restart engine 22.

Before stopping engine 22 as function of the stop-start system, the illustrated embodiment performs one or more diagnostic tests on starter 30 to check the operability of starter motor 32 and solenoid 42. Only after the diagnostic checks are passed will ECU 48 turn off engine 22 as a function of the stop-start system. Although it will generally be advantageous to check both motor 32 and solenoid 42 prior to stopping engine 22 as a function of the stop-start system, alternative embodiments could perform a diagnostic check on only motor 32 or only solenoid 42 instead of both diagnostic checks.

If either of the diagnostic checks fail, ECU 48 will suspend operation of the stop-start system and will not stop engine 22 as a function of the stop-start system. In such an event, the stop-start system could be suspended until the operator intentionally stops the vehicle with the stop-start system returning to operation after the vehicle is restarted by the operator. Alternatively, the stop-start system could suspend operation of the stop-start system for only one stop-start cycle and when vehicle 20 satisfies the conditions necessary to restart engine 22 following the failed diagnostic check, the stop-start system could once again return to normal operation. In such a case, ECU 48 would once again perform the diagnostic checks before stopping the engine at the next event which satisfies the conditions for stopping engine 22 as a function of the stop-start system. Still other alternatives are also possible, for example, it would also be possible to require the operator of the vehicle or a repair technician to purposely restart the operation of the stop-start system by depressing a dedicated button for such purposes or through other input means.

It is also noted that, as used herein, suspension of the stop-start system means only that ECU 48 has suspended the stopping of engine 22, the software governing the operation of the stop-start system may continue to run in ECU 48 and the sensors employed with the system will continue to operate while the operation of the stop-start system is "suspended."

The diagnostic checks performed by the illustrated embodiment will now be described. The first diagnostic check is used to check the operability of starter motor 32. FIG. 2 illustrates the condition where starter motor 32 is inactive and solenoid plunger 42 is in an extended position whereby pinion 40 is disengaged from ring gear 28 and is in its home position. This will be the condition of the starter when engine 22 is running and vehicle 20 is being actively driven. If the operator of vehicle 22 applies the brake and bring vehicle 20 to a stop, ECU 48 will determine if the conditions necessary to temporarily stop engine 22 as a function of the stop-start system are met. If the conditions are met, ECU 48 will perform a diagnostic check of starter 30 before stopping engine 22. With engine 22 still running, ECU 48 will energize or pulse (temporarily energize) motor 32 without energizing solenoid 42, i.e., pinion gear 40 remains in its home position, and monitor sensor 50. This condition is illustrated in FIG. 3.

There will be a slight delay between the energizing or pulsing of motor 32 and the rotation of the armature and the resulting rotation of ferrous targets 58 because motor 32 will not react instantaneously. If sensor 50 detects rotation, this indicates that motor 32 is operable. If no rotation is detected, this is a failure of the first diagnostic check and indicates that motor 32 is inoperable. In the event of such a failure, ECU 48 will not stop engine 22 as a function of the stop-start system. It is noted that this first diagnostic check may be advantageously performed as vehicle 20 is slowing down or stopped and engine 22 is at or near an engine idling speed. It is further noted that because engine 22 is still running when this diagnostic check is performed, the sound of engine 22 will likely mask the noise generated by pulsing motor 32.

If motor 32 is operable and the first diagnostic check is passed, ECU proceeds to conduct a second diagnostic check which determines whether or not solenoid 42 is operable. With the armature and ferrous targets 58 still rotating following the energizing or pulsing of motor 32, solenoid 42 is temporarily energized. Sensor 50 can only detect rotation of targets 58 when pinion 40 is in the home position and targets 58 are positioned immediately adjacent to sensor 50. When solenoid 42 is energized and shift lever 44 biases shaft 34 and thus overrunning clutch 38 and targets 58 toward ring gear 28, targets 58 will no longer be adjacent to sensor 50. When targets 58 have been biased out of the home position, sensor 50 will not be able to detect the rotation of targets 58 and sensor 50 will indicate a zero rotational speed even if shafts 34, 36, overrunning clutch 38, pinion 40 and targets 58 are rotating. Thus, if sensor 50 detects a zero rotational speed within a predetermined time period after pulsing solenoid 42 with pinion 40 still coasting after the pulsing of motor 32, the detection of such a zero rotational speed will indicate that solenoid 42 is operable and biased targets 58 away from sensor 50. If sensor 50 continues to detect a non-zero rotational speed during a predetermined time period after pulsing solenoid 42, it will be a failure of the second diagnostic test and indicate that solenoid 42 is inoperable.

If motor 32 was initially pulsed instead of maintained in an energized condition, it is possible that pinion 40 will stop inertially rotating during the predetermined time period. This could cause the second diagnostic test to erroneously indicate that solenoid 42 is functional. To prevent this potential error, the second diagnostic test may optionally include a further step of de-energizing solenoid 42 and allowing pinion gear 40 to return to its home position and using sensor 50 to determine if pinion gear 40 is still rotating. If sensor 50 detects a non-zero rotational speed after pinion gear 40 is returned to the home position and targets 58 are once again positioned to be detected by sensor 50, this will indicate that a zero rotational speed during the first predetermined time period was due to solenoid 42 biasing pinion gear 40 out of the home position and not due to pinion gear 40 stopping rotation due to friction.

In other words, in this alternative version of the second diagnostic check, after detecting the rotation of pinion gear 40 with sensor 50, solenoid 42 is energized while pinion gear 40 is rotating and sensor 50 is monitored for the detection of a zero rotational speed. If a zero rotational speed is detected by sensor 50 within a predetermined time period after energizing solenoid 42, sensor 50 is monitored for the detection of a non-zero rotational speed within a second predetermined time period that follows both the detection of the zero rotational speed and the de-energizing of solenoid 42. Only if sensor 50 detects a non-zero rotational speed during a second predetermined time period following the latter of detecting a non-zero rotational speed and de-energizing solenoid 42 is this alternative version of the second diagnostic test considered to be passed. If the first attempt at passing the second diagnostic check is unsuccessful, the second diagnostic check can be designated a failure and the stop-start system suspended. Alternatively, if the second diagnostic test was performed by pulsing motor 32 and the second diagnostic check was failed due to a failure to detect a non-zero rotational speed after de-energizing solenoid 42, a second attempt at the second diagnostic check may be performed before designating it a failure. The second diagnostic check can be repeated either by pulsing motor 32 or by energizing motor 32 throughout the duration of the second diagnostic check. If the second attempt at the second diagnostic check fails, the second diagnostic check is designated a failure and the operation of the stop-start system is suspended.

During this second diagnostic check, engine 22 will be at no more than an idling speed and solenoid 42 will only be temporarily energized or pulsed. Thus, the sound and wear of pinion gear 40 contacting ring gear 28 will be minimized. Commonly, the clearance distance between pinion 40 and ring gear 28 is approximately 2 to 4 mm. To further limit wear and noise generated by the diagnostic testing of solenoid 42, this distance can be increased. For example, FIG. 4 illustrates pinion gear 40 in a position between the home position (FIGS. 2 and 3) and a position where pinion gear 40 is fully engaged with gear ring 28 (FIG. 5).

By increasing the clearance of pinion 40, the duration of the pulse used to energize solenoid 42 and the strength of return spring 64 can be adapted whereby the force exerted by spring 64 can balance the retraction force generated by the solenoid coils over the travel distance of pinion 40 such that pinion 40 either does not engage ring gear 28 or impacts ring gear 28 with only a minimal force to thereby reduce wear and noise caused by testing solenoid 42. FIG. 4 illustrates pinion gear 40 in an intermediate position after pulsing solenoid 42 and with pinion gear 40 still rotatably coasting after the pulsing of motor 32. In this intermediate position, targets 58 are no longer adjacent sensor 50 and sensor 50 will detect a zero rotational speed even though pinion gear 40 and targets 58 are still rotating.

FIG. 5 illustrates pinion gear 40 engaged with ring gear 28 and motor 32 de-energized. If pinion gear 40 is biased into engagement with ring gear 28 by the pulsing of solenoid 42, this will be the position of pinion gear 40. In this position, similar to that shown in FIG. 4, targets 58 will be displaced relative to sensor 50 and sensor 50 will detect a zero rotational speed even though pinion gear 40 and targets 58 are rotating.

Thus, in this second diagnostic check, with sensor 50 detecting the rotation of targets 58 in the home position, solenoid 42 is pulsed and if sensor 50 then detects a zero rotational speed due to the displacement of targets 58 by the pulsing of solenoid 42 (e.g., by shifting pinion gear 40 into either of the positions shown in FIG. 4 or 5), the operability of solenoid 42 is confirmed. If, on the other hand, sensor 50 continues to detect the rotation of targets 58 after pulsing solenoid 42, this is indicates that solenoid 42 is inoperable and constitutes a failure of the second diagnostic check. In the event of such a failure, ECU 48 will not stop engine 22 as a function of the stop-start system.

If both of the diagnostic checks are passed and the conditions for stopping engine 22 are still satisfied, ECU 48 will stop engine 22 as a function of the stop-start system. Engine 22 will then remain stopped until ECU 48 detects a change in conditions that prompts an automatic restarting of engine 22, e.g., the operator no longer is applying the brake. ECU 48 will then energize motor 32 and compare the rotational speeds of ring gear 28 and pinion 40. When the two speeds are sufficiently similar, solenoid 42 will be energized to engage pinion 40 with ring gear 28 and restart engine 22.

ECU 48 is operably coupled with communication device 54 whereby information may be conveyed to the operator of vehicle 20. For example, communication device 54 may take the form of a dashboard warning light that is illuminated if either of the diagnostic checks are failed. For example, many vehicles have a generic warning light, e.g., a "check engine" light, that could be illuminated if one of the diagnostic checks are failed. Alternatively, a dedicated light could be illuminated if one of the diagnostic checks are failed whereby device 54 communicates more specifically that a fault has occurred in the stop-start system. For example, one or more dashboard lights could be dedicated to informing the vehicle operator about the status of the stop-start system, illuminating a particular light when the engine has been stopped as a function of a normally operating stop-start system and illuminating a different color light or flashing light to inform the vehicle operator that a fault has occurred in the stop-start system when a diagnostic check failure occurs. Alternatively, if vehicle 20 includes a more sophisticated display screen, e.g., a display screen capable of displaying text and images in a variety of different configurations, the display device could provide even more specific information about the status of the stop-start system, e.g., that it is operating normally or that the starter motor has failed a diagnostic check and that operation of the stop-start system has been suspended.

It is noted that diagnostic tests described herein can be used individually instead of together. For example, some starter designs may allow for the convenient implementation of only one of the diagnostic tests or benefit more significantly from one test whereby it is more cost efficient to employ only one test or the delay in shutting off the engine outweighs the benefits of employing both tests.

It is further noted that alternative embodiments could employ additional sensors to check the operability of motor 32 and/or solenoid 42. The illustrated embodiment, however, advantageously utilizes sensor 50 which is employed to synchronize the rotational speed of pinion 40 with ring gear 28 to perform a diagnostic check of both motor 32 and solenoid 42 and thereby provides a highly cost-efficient method of determining the operability of motor 32 and solenoid 42 before stopping engine 22 as a function of a stop-start system.

While this invention has been described as having an exemplary design, the present invention may be further modified within the spirit and scope of this disclosure. This application is therefore intended to cover any variations, uses, or adaptations of the invention using its general principles.

What is claimed is:

1. A diagnostic system for a vehicle with an internal combustion engine and a starter-based stop-start system comprising:

an electronic control unit configured to control the operation of the stop-start system;

a starter having an electric motor drivingly coupled with a shaft assembly;

a first gear mounted on the shaft assembly;

a solenoid operably coupled with the shaft assembly wherein operation of the solenoid shifts the first gear into and out of engagement with a second gear, the second gear being coupled with the engine and wherein the engine is startable by rotating the second gear with the first gear;

a sensor operably coupled with the shaft assembly for detecting rotational movement of the shaft assembly in a first position wherein the first gear is disengaged from the second gear;

the electronic control unit being operably coupled with the starter motor, the solenoid and the sensor, wherein the electronic control unit performs at least one of a first diagnostic check and a second diagnostic check before stopping the engine as a function of the stop-start system wherein:

in the first diagnostic check the electronic control unit energizes the starter motor with the first gear disengaged from the second gear and then, with the shaft assembly in the first position, uses the sensor to determine if the shaft assembly is rotating wherein a rotating shaft assembly indicates that the starter motor is operable and a non-rotating shaft assembly indicates a starter motor failure; and in the second diagnostic check, the electronic control unit detects the rotational speed of the shaft assembly with the sensor while the shaft assembly is in the first position and the shaft assembly is rotating, the electronic control unit then energizes the solenoid to move the shaft assembly out of the first position to a second position where the sensor cannot detect rotation of the shaft assembly and then analyzes the signals provided by the sensor after energizing the solenoid wherein sensor signals representing no detected rotation of the shaft assembly after energizing the solenoid to move the shaft assembly to the second position indicates that the solenoid is operable and sensor signals representing a non-zero rotational speed of the shaft assembly after energizing the solenoid to move the shaft assembly to the second position indicates a solenoid failure due to the solenoid failing to move the shaft assembly out of the first position; and wherein, if a starter motor failure or a solenoid failure is detected when conducting the at least one of the first and second diagnostic checks, the electronic control unit suspends operation of the stop-start system.

2. The diagnostic system of claim 1 wherein the system performs the first diagnostic check.

3. The diagnostic system of claim 1 wherein the system performs the second diagnostic check.

4. The diagnostic system of claim 3 wherein the shaft assembly is movable by the solenoid into an intermediate position between an engaged position and the first position wherein the first gear is not engaged with the second gear in the intermediate position and wherein the second position is the intermediate position.

5. The diagnostic system of claim 1 wherein the system performs the first and second diagnostic checks.

6. The diagnostic system of claim 5 wherein, when performing the first and second diagnostic checks, the motor is energized and then de-energized to rotate the shaft assembly and wherein, when performing the second diagnostic check, the solenoid is energized after de-energizing the motor.

7. The diagnostic system of claim 6 wherein the second diagnostic check is performed immediately after completing the first diagnostic check and wherein a single energizing and de-energizing of the starter motor is used to accomplish both the first and second diagnostic checks.

8. The diagnostic system of claim 7 wherein the second diagnostic check further comprises monitoring the sensor for a non-zero rotational speed during a predetermined time period following the detection of a zero rotational speed and de-energizing of the solenoid and wherein the second diagnostic check indicates the solenoid is operable only if a non-zero rotational speed is detected during the predetermined time period.

9. The diagnostic system of claim 7 wherein the first gear is biased into contact with the second gear by energizing the solenoid during the second diagnostic check.

10. The diagnostic system of claim 7 wherein the shaft assembly is movable by the solenoid into an intermediate position between an engaged position and the first position wherein the first gear is not engaged with the second gear in the intermediate position and wherein the second position is the intermediate position.

11. The diagnostic system of claim 5 wherein the first and second diagnostic checks are performed after the electronic control unit determines that operating conditions necessary to temporarily stop the engine as a function of the stop-start system are satisfied.

12. The diagnostic system of claim 1 wherein the first gear is a pinion gear, the second gear is a ring gear, and wherein the sensor is a Hall effect sensor and the shaft assembly includes an overriding clutch assembly and a plurality of circumferentially spaced ferrous targets mounted on the clutch assembly wherein the targets are detectable by the Hall effect sensor.

13. The diagnostic system of claim 1 wherein, if a diagnostic check failure occurs, the electronic control unit communicates a warning signal to the operator of the vehicle.

14. The diagnostic system of claim 13 wherein the warning signal communicates that a failure has occurred in the stop-start system.

15. A method of performing a diagnostic check for a vehicle with an internal combustion engine and a starter-based stop-start system comprising:

providing a starter having an electric motor drivingly coupled with a shaft assembly;

providing a first gear on the shaft assembly;

operably coupling a solenoid with the shaft assembly wherein the solenoid selectively shifts the first gear into and out of engagement with a second gear, the second gear being coupled with the engine and wherein the engine is startable by rotating the second gear with the first gear;

operably coupling a sensor with the shaft assembly wherein the sensor detects rotational movement of the shaft assembly when the shaft assembly is in a first position with the first gear disengaged from the second gear;

performing at least one of a first diagnostic check and a second diagnostic check before stopping the engine as a function of the stop-start system wherein:

the first diagnostic check includes energizing the starter motor with the first gear disengaged from the second gear and then, with the shaft assembly in the first position, using the sensor to determine if the shaft assembly is rotating wherein a rotating shaft assembly indicates that the starter motor is operable and a non-rotating shaft assembly indicates a starter motor failure; and the second diagnostic check includes detecting the rotational movement of the shaft assembly with the sensor while the shaft assembly is in the first position and the shaft assembly is rotating and then energizing the solenoid to move the shaft assembly out of the first position to a second position where the sensor cannot detect rotation of the shaft assembly and analyzing the signals provided by the sensor after energizing the solenoid wherein sensor signals representing no detected rotation of the shaft assembly after energizing the solenoid to move the shaft assembly to the second position indicates that the solenoid is operable and sensor signals representing a non-zero rotational speed of the shaft assembly after energizing the solenoid to move the shaft assembly to the second position indicates a solenoid failure due to the solenoid failing to move the shaft assembly out of the first position; and suspending operation of the stop-start system if a starter motor failure or a solenoid failure is detected by the at least one of the first and second diagnostic checks.

16. The method of claim 15 further comprising operably coupling an electronic control unit with the starter motor, the solenoid and the sensor and performing the first diagnostic check with the electronic control unit.

17. The method of claim 15 further comprising operably coupling an electronic control unit with the starter motor, the solenoid and the sensor and performing the second diagnostic check with the electronic control unit.

18. The method of claim 15 further comprising operably coupling an electronic control unit with the starter motor, the solenoid and the sensor and performing both the first diagnostic check and the second diagnostic check with the electronic control unit and wherein the first and second diagnostic checks are performed after the electronic control unit determines that operating conditions necessary to temporarily stop the engine as a function of the stop-start system are satisfied.

19. The method of claim 18 wherein the system performs the first and second diagnostic checks and wherein, when performing the second diagnostic check, the motor is energized and then de-energized to rotate the shaft assembly and the solenoid is energized after de-energizing the motor and wherein the second diagnostic check is performed immediately after completing the first diagnostic check whereby a single energizing and de-energizing of the starter motor is used to accomplish both the first and second diagnostic checks.

20. The method of claim 19 wherein the first gear is a pinion gear, the second gear is a ring gear, the sensor comprises a Hall effect sensor, the shaft assembly includes an overriding clutch assembly and a plurality of circumferentially spaced ferrous targets are mounted on the clutch assembly wherein the targets are detectable by the Hall effect sensor and, if a diagnostic check failure occurs, the electronic control unit communicates a warning signal to the operator of the vehicle.

* * * * *